US005709377A

United States Patent [19]

Yoshioka et al.

[11] Patent Number: 5,709,377

[45] Date of Patent: Jan. 20, 1998

[54] IMAGE FORMING APPARATUS

[75] Inventors: Yoshiki Yoshioka; Yoshiyuki Fujiwara; Ken Nishio, all of Osaka, Japan

[73] Assignee: Mita Industrial Co., Ltd., Osaka, Japan

[21] Appl. No.: 606,413

[22] Filed: Feb. 23, 1996

[30] Foreign Application Priority Data

Mar. 6, 1995 [JP] Japan ..... 7-045987

[51] Int. Cl.[6] ..... B65H 3/44; B65H 5/26

[52] U.S. Cl. ..... 271/9.02; 271/9.05; 399/81

[58] Field of Search ..... 271/9.02, 9.03, 271/9.05, 9.06, 9.08; 399/81

[56] References Cited

U.S. PATENT DOCUMENTS

| | | | |
|---|---|---|---|
| 4,804,997 | 2/1989 | Mizude et al. | 271/9.06 |
| 4,908,672 | 3/1990 | Ito | 271/9.06 |
| 5,130,757 | 7/1992 | Ito | 271/9.06 |
| 5,150,890 | 9/1992 | Kunikawa et al. | 271/9.05 |
| 5,289,236 | 2/1994 | Yoshino | 271/9.06 |
| 5,387,968 | 2/1995 | Wakikaido et al. | 399/81 |
| 5,446,524 | 8/1995 | Koike | 271/9.06 |
| 5,502,555 | 3/1996 | Lakatos | 271/9.05 |

FOREIGN PATENT DOCUMENTS

| | | | |
|---|---|---|---|
| 3264435 | 11/1991 | Japan | 271/9.05 |
| 4358651 | 12/1992 | Japan | 271/9.06 |
| 5139557 | 6/1993 | Japan | 271/9.06 |

*Primary Examiner*—H. Grant Skaggs
*Attorney, Agent, or Firm*—Rabin, Champagne & Lynt, P.C.

[57] ABSTRACT

Special sheets to be handled differently from normal sheets are accommodated in a specific sheet feeding deck such that a predetermined operation or presentation associated with reproduction procedure is permitted or prohibited for the special sheets in the specific sheet feeding deck. For example, if the production of two-sided copies is prohibited for a specific sheet feeding deck which accommodates sheets to be used again, the sheets are not automatically selected during the production of two-sided copies even if they are of the same size as a document original. This ensures erroneous handling is prevented, such as image forming on both sides of the special sheets in the specific sheet feeding deck.

6 Claims, 13 Drawing Sheets

IMAGE FORMING APPARATUS

BACKGROUND OF THE INVENTION

The present invention relates generally to an image forming apparatus such as a copying machine. More particularly the present invention is directed to an image forming apparatus which is adapted to obtain a final copied image by forming images of an original document on normal copy sheets which are blank on both sides (hereinafter referred to as "normal sheets"), as well as special copy sheets (hereinafter referred to as "special sheets") which a user loads in a sheet feeding deck instead of the normal sheets.

Conventionally, the typical copying machine is adapted to optically scan an image of an original document. An electrostatic latent image corresponding to the scanned image of the original document is then formed on a photoconductive material. The electrostatic latent image is developed into a toner image. Then, the resultant toner image is transferred onto a normal sheet, In such a copying machine, an operator selects and loads a desired copy sheet in a sheet feeding deck, and uses the same for the production of copies (In this specification, the term "deck" includes a cassette.)

There are two general types of copy sheets, which include normal sheets, as well as special sheets which a user utilizes for special purposes. The special sheets may include, for example, sheets in which with the front side thereof is already copied and the back side is to be copied, and sheets having an address, name or the like printed on one side thereof.

Usually, there is a special sheet feeding deck provided, with a special sheet mark attached thereto, in which an operator may load special sheets therein.

However, the prior art machines do not handle the special sheets loaded in the special sheet feeding deck any differently from normal sheets loaded in the other sheet feeding decks.

For example, when selecting a sheet feeding deck holding sheets of the same size as a detected document original, or sheets having a predetermined magnification relation therewith, the special sheet feeding deck holding the special sheets is not handled specially because of its content, but is subject to the same selection process as the other sheet feeding decks prior to the image forming operations.

A copying machine having an autochanging function for automatically changing sheet feeding decks is typically arranged such that if a sheet feeding deck has run out of sheets to feed, another sheet feeding deck holding sheets of the same size is automatically selected to continue the production of copies. The automatic selection of "another sheet feeding deck" is performed without distinction of whether the deck is a sheet feeding deck holding special sheets. Accordingly, when the copying machine with a special sheet feeding deck holding special sheets is set on special sheets in the two-side copy mode, the special sheet feeding deck is automatically selected, and normal sheets and the special sheets may be mixed together. Furthermore, an additional problem exists that the special sheets are rendered into two-sided copies with the information on the backside thereof overlapping other text.

SUMMARY OF THE INVENTION

It is therefore an objective of the present invention to provide an image forming apparatus adapted to specify a specific sheet feeding deck, thereby preventing erroneous operations on sheets contained in the specified sheet feeding deck.

The image forming apparatus of the invention for achieving the aforesaid objective is characterized by: means for setting or detecting a specific sheet feeding deck, and control means for permitting or prohibiting a predetermined operation or presentation associated with the reproduction procedure with respect to sheets contained in a sheet feeding deck thus set or detected by the aforesaid means or to sheets contained in the other sheet feeding decks.

In the aforesaid image forming apparatus, a predetermined operation or presentation associated with the reproduction procedure can be permitted or prohibited with respect to sheets contained in the specific sheet feeding deck or to sheets contained in the other sheet feeding decks. Therefore, erroneous operations or unwanted operations are not performed on special sheets, which are to be handled differently from normal sheets, if the special sheets are accommodated in the specific sheet feeding deck.

Any type of sheets may be handled as special sheets, as long as a user regards them as being other than normal sheets. Examples of such special sheets may include sheets to be used again or sheets with a sender's address preprinted thereon for example, if, but are not limited to these. If, according to a specified use of a copying machine, sheets to be reused are usually used, whereas sheets (typically called normal sheets) which are blank on both sides thereof are put to special use, the sheets to be reused may be called normal sheets while the sheets blank on both sides thereof may be called special sheets.

According to the image forming apparatus of the invention as described above, accommodating special sheets in a specific sheet feeding deck ensures erroneous, unwanted image operations are not performed on the special sheets, which should be handled differently from normal sheets.

In a second embodiment of the invention, the means for setting or detecting a specific sheet feeding deck may allow an operator to make settings for a specific sheet feeding deck through manual input. In this arrangement, the operator identifies a specific sheet feeding deck through manual input. Accordingly, a specific sheet feeding deck may be changed readily, although the input procedure is cumbersome.

In a third embodiment of the invention, the means for setting or detecting a specific sheet feeding deck may detect a specific sheet feeding deck by automatically identifying an identifier attached to the sheet feeding deck. In this arrangement, the specified sheet feeding deck is automatically detected. Accordingly, the input procedure is simple, although the sheet feeding deck is not readily changed.

In a fourth embodiment, a predetermined operation associated with the reproduction procedure may designate sheets in the sheet feeding deck as the target of automatic sheet selection. In this arrangement, sheets in one sheet feeding deck may be designated as the target of the automatic sheet selection, or sheets in another sheet feeding deck may be designated as the target. Accordingly, if special sheets to be handled differently from normal sheets are accommodated in a specific sheet feeding deck, they are not automatically selected for the image forming operations, viz., they are not selected unless a special setting is made manually, even if they are of the same size as a document original. This ensures the prevention of unwanted image forming operations erroneously performed on the special sheets. Alternatively, sheets to be reused, which are less costly than normal sheets, may be accommodated in a sheet feeding deck other than a specific one while the normal sheets may be accommodated in a specific sheet feeding deck, so that only sheets to be reused are generally used, with the normal sheets being restricted to special image forming operations.

In a fifth embodiment, a predetermined operation associated with the reproduction procedure may include designating in the sheet feeding deck as the target for the automatic changing of sheets (autochanging). In this arrangement, sheets in the sheet feeding deck may be designated as the target for the automatic changing of sheets. Alternatively, sheets in the other sheet feeding decks may be designated as the target. Accordingly, if special sheets to be handled differently from normal sheets are accommodated in a specific sheet feeding deck, they are not selected for the image forming operations, viz., they are not selected unless a special setting is made manually, even though sheets of the same size as the special sheets are used up during the image forming operations. This ensures unwanted image forming operations are prevented from being erroneously performed on the special sheets. Alternatively, special sheets may be accommodated in a specific sheet feeding deck such that only the specific sheet feeding deck is automatically selected for the image forming operations. Alternatively, a setting may be made such that normal sheets of the same size as the special sheets are not automatically selected when the special sheets are used up during the image forming operations. This prevents the resultant copies from including normal sheets and special sheets mixed together.

A sixth embodiment of the invention includes a predetermined presentation associated with the reproduction procedure, which may include a presentation indicative of the selection of the sheet feeding deck for the image forming operations. In this arrangement, if special sheets which are to be handled differently from normal sheets, are accommodated in a specific sheet feeding deck or in a deck other than the normal sheet feeding deck, a message indicative of the selection of the sheet feeding deck is presented upon the selection thereof, thereby bringing the selection to the attention of an operator. This ensures unwanted image forming operations are prevented from being erroneously performed on the special sheets.

In a seventh embodiment of the invention, a predetermined operation associated with the reproduction procedure may prohibit the operation of the sheet feeding deck when it is selected to feed sheets for the production of two-sided copies. In this arrangement, the operation of the sheet feeding deck is prohibited when it is selected to feed sheets for the production of two-sided copies, Thus, the image forming operation is efficiently prohibited if, for example, special sheets are to be used again, and the formation of an image on the back side thereof is unwanted.

In an eighth embodiment of the invention, a predetermined operation associated with the reproduction procedure may lock the sheet feeding deck which is selected to feed sheets, unless a predetermined release operation is performed. In this arrangement, the sheet feeding deck which is selected to feed sheets, is locked, viz., the selection or removal thereof is prevented, unless a predetermined release operation is performed. Thus, if special sheets are accommodated in the sheet feeding deck, those who may use the special sheets are restricted to certain operators, thereby preventing unexpected image formation.

The foregoing and other objects of the present invention will be apparent from the following description taken in connection with the accompanying drawings.

BRIEF DESCRIPTION OF THE DRAWINGS

FIG. 13A is a diagram illustrating the rear end surface of the sheet feeding deck with the special sheet mark (92) affixed thereto, while FIG. 13B illustrates lock means comprised of the combination of a solenoid (93) and a lock arm (94).

DETAILED DESCRIPTION PREFERRED EMBODIMENTS

Figure 1:
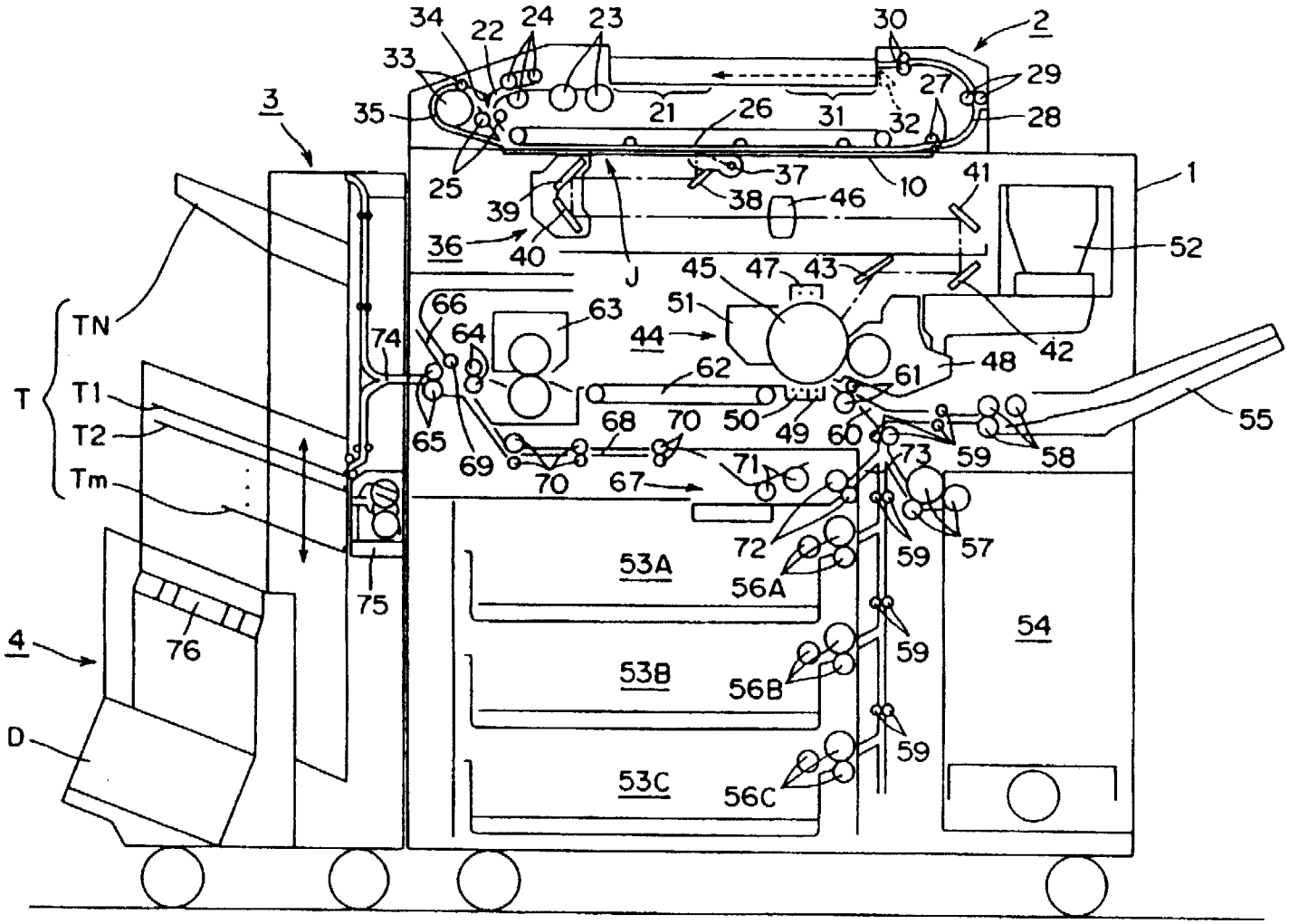
FIG. 1 is a schematic view illustrating an example of a copying machine incorporating an image forming apparatus according to the present invention.

FIG. 1 is a schematic view of an example of the arrangement a copying machine incorporating an image forming apparatus according to the invention. The copying machine comprises a main body 1, Reversible Document Holder 2 (hereinafter referred to as RDH) mounted atop the main body 1, a sorter 3 for sorting copy sheets exiting from the main body 1 and sortably discharging the copy sheets into plural bins TN, T1, T2, . . . Tm (hereinafter referred to generally as "bin T"), and a stacker 4 for collecting copy sheets discharged in the bin T to stack them in a stacking section D.

A transparent platen 10 is disposed on the top surface of the main body 1 of the copying machine. If a document original to be reproduced is one-sided, it should be placed at an image forming position J (position exposed to light) on the platen 10 with the front image side thereof turned downward. If a document original to be reproduced is two-sided, it should be placed at the image forming position J with either of the sides thereof turned downward.

RDH 2 automatically feeds document originals to the image forming position J on the platen 10. RDH 2 comprises sheet feeding rollers 23 and primary sheet feeding rollers 24. The rollers take out the document originals (set at a document original setting position 21) one sheet at a time from the bottom of the stack, and to feed it into a sheet feeding passage 22. The sheet is fed the platen 10 using (secondary) sheet feeding rollers 25 and a transport belt 26.

RDH 2 also includes reverse rollers 33 which reverse a two-sided document original after completion of the reproduction of one side thereof, and feeds the two-sided document original to the image forming position J when a two-side copy mode is selected to produce two-sided copies from a two-sided document original, or when a separate copy mode is selected to produce two one-sided copies from a two-sided document original. The two-sided document original, after one side of which has been reproduced, is returned to the sheet feeding passage 22 by the transport belt 26 and guided into a reverse passage 35 by a reverse action of the secondary sheet feeding roller 25 being reversed which and a separator claw 34 which closes the sheet feeding passage 22 side. The two-sided document original guided into the reverse passage 35 is advanced by means of the rotation of the reverse roller 33 to the image forming position J.

Upon completion of the reproduction, the document original is guided into a sheet exit passage 28 by a primary sheet discharge roller 27, and is discharged to a document original exit position 31 through a relay roller 29 and a secondary sheet discharge roller 30. When all document originals positioned at the document original setting position 21 have been discharged to the document original exit position 31, all the document originals are automatically positioned again at the document original setting position 21 by a document original sheet feed plate 32.

The main body 1 of the copying machine includes therein a document original reading section 36. The document original reading section 36 comprises a light source 37 that scans by illuminating a document original placed at the image forming position J on the platen 10. The light source 37 is driven laterally to reciprocate along the platen 10 using a nonillustrated motor of an optical system. Light rays from the light source 37 are reflected by the document original placed at the image forming position J. The light rays reflected from the document original are reflected by a first reflecting mirror 38 driven in unison with the light source 37, and then reflected by a second reflecting mirror 39, a third reflecting mirror 40, a fourth reflecting mirror 41, a fifth reflecting mirror 42, and a sixth reflecting mirror 43, so as to be guided onto a photoconductive drum 45 provided at an image forming section 44. The second reflecting mirror 39 and the third reflecting mirror 40 are moved laterally in FIG. 1 at half of the speed that the light source 37 is moving, whereby the length of the optical path from the light source 37 to the photoconductive drum 45 is maintained constant throughout the process of scanning the document original with the light rays from the light source 37. Disposed between the third reflecting mirror 40 and the fourth reflecting mirror 41 is a zoom lens 46 for focusing an image of the document original on the photoconductive drum 45.

The image forming section 44 includes the aforesaid photoconductive drum 45 driven to rotate at a constant speed during the production of copies, as well as a main corona charger 47, a developing unit 48, an image transfer charger 49, a sheet separation charger 50 and a cleaning unit 51, which are disposed at the periphery of the photoconductive drum 45 sequentially in the direction of the rotation thereof.

After being uniformly charged by the main corona charger 47, the surface of the photoconductive drum 45 is exposed to light rays reflected from a document original. As a result, an electrostatic latent image corresponding to an inverted image of the document original is formed on the surface of the photoconductive drum 45. In the developing unit 48, the electrostatic latent image is developed into a toner image by toner powder fed from a toner hopper 52. The toner image is transferred onto a copy sheet by the image transfer charger 49. After the toner image is transferred from the surface of the photoconductive drum 45, the toner powder remaining thereon is removed by the cleaning unit 51. The sheet separation charger 50 separates the copy sheet from the surface of the photoconductive drum 45. The main corona charger 47, the image transfer charger 49 and the sheet separation charger 50 effect their respective functions by causing a corona discharge.

In synchronism with the copying operation by the image forming section 44, a copy sheet is fed from any one of an upper deck 53A, a middle deck 53B, a lower deck 53C, a bulk deck 54 and a manual feed tray 55. The upper deck 53A and the lower deck 53C accommodate copy sheets blank on the both sides thereof and having different sizes from each other (hereinafter referred to normal sheets as General). The bulk deck 54 and the middle deck 53B accommodate special sheets different from the normal sheets in the decks 53A and 53C. More specifically, the bulk deck 54 accommodates a large volume of sheets to be reused in which the front side thereof is copied already and the back side thereof is to be copied. The middle deck 53B accommodates special sheets with an address, name or the like printed on one side thereof. A manual feed tray is represented by the reference number 55.

Paper take-out rolls 56A, 56B, 56C, 57 and 58 for taking out normal or special sheets one at a time are provided in association with the upper deck 53A, the middle deck 53B, the lower deck 53C, the bulk deck 54 and the manual feed tray 55, respectively. During the production of copies, any one of the paper take-out rolls 56A, 56B, 56C, 57 and 58 is driven to rotate, thereby guiding normal or special sheets from any one of the upper deck 53A, the middle deck 53B, the lower deck 53C, the bulk deck 54 and the manual feed tray 55, through a relay roller 59, and into a sheet transport passage 60 which extends to the vicinity of the photoconductive drum 45.

A pair of resist rollers 61 are provided in the sheet transport passage 60 close to the photoconductive drum 45. The resist rollers 61 temporarily halt a normal sheet or a special sheet and thereafter, feeds the same to the photoconductive drum 45 in a motion that is synchronized with the rotation of the photoconductive drum 45. Thus, the normal or special sheet is fed to the photoconductive drum 45 so synchronized as to be overlapped with a toner image on the surface of the photoconductive drum 45 at the image transfer charger 49.

A copy sheet having a toner image transferred thereon by the image transfer charger 49 is separated from the surface of the photoconductive drum 45 by the sheet separation charger 50, and then is guided to a fixing unit 63 by a transport belt 62. The fixing unit 63 fixes the toner powder on the surface of a copy sheet. After the fixing process, the copy sheet is carried to the sorter 3 by a transport roller 64 and a sheet discharge roller 65.

A reverse passage 66 and an intermediate passage 68 branch out from a passage between the transport roller 64 and the sheet discharge rollers 65. Reverse passage 66 reverses a copy sheet after the fixing process. Intermediate passage 68 transports a copy sheet to an intermediate tray 67 disposed at a central portion of the main body 1. After the fixing process, the copy sheet is first guided into the reverse passage 66 by an unillustrated separator claw and a reverse roller 69, and is then guided into the intermediate passage 68 by a reverse rotation of the reverse roller 69. The intermediate passage 68 is provided with transport rollers 70 at proper intervals. Copy sheets held in the intermediate tray 67 are taken out by sheet feeding rollers 71 and 72 one at a time to be guided into a transport passage 73 joining the sheet transport passage 60.

The intermediate tray 67 is used when the two-side copy mode or the separate copy mode is effected. Specifically, copy sheets having been copied on one side thereof are reversed in the reverse passage 66 and then are guided into the intermediate passage 68 to be received by the intermediate tray 67, from where the sheets are guided again to the photoconductive drum 45 through the transport passage 73 and the sheet transport passage 60.

The sorter 3 includes a plurality of bins T as described above. Once discharged by the sheet discharge roller 65, copy sheets are guided into a sheet discharge passage 74 to be sorted into a predetermined bin T by a sorting mechanism not shown in the figure. Out of the plural bins T, a bin TN is a non-sorting bin which is used when copied sheets are discharged without a sorting process. When copied sheets are discharged through the sorting process, the other bins T1, T2, . . . , Tm are used as sorting bins.

The sorter 3 is also provided with a punching/stapling unit 75 for performing a punching or stapling process wherein plural copied sheets guided into any one of the sorting bins T1, T2, . . . , Tm are bound by, for example, a stapler. The sorting bins T1, T2, . . . , Tm are vertically movable. To perform the punching or stapling process, any one of the sorting bins T1, T2, . . . , Tm accommodating copied sheets to be subject to the punching or stapling process is caused to move to a position corresponding to the punching/stapling unit 75.

The stacker 4 stacks in a stacking section D copy sheets which have been punched or stapled by the punching/stapling unit 75. The copy sheets which have been punched or stapled are taken out by a take-out unit 76 provided at the stacker 4 are guided into the stacking section D.

Figure 2:
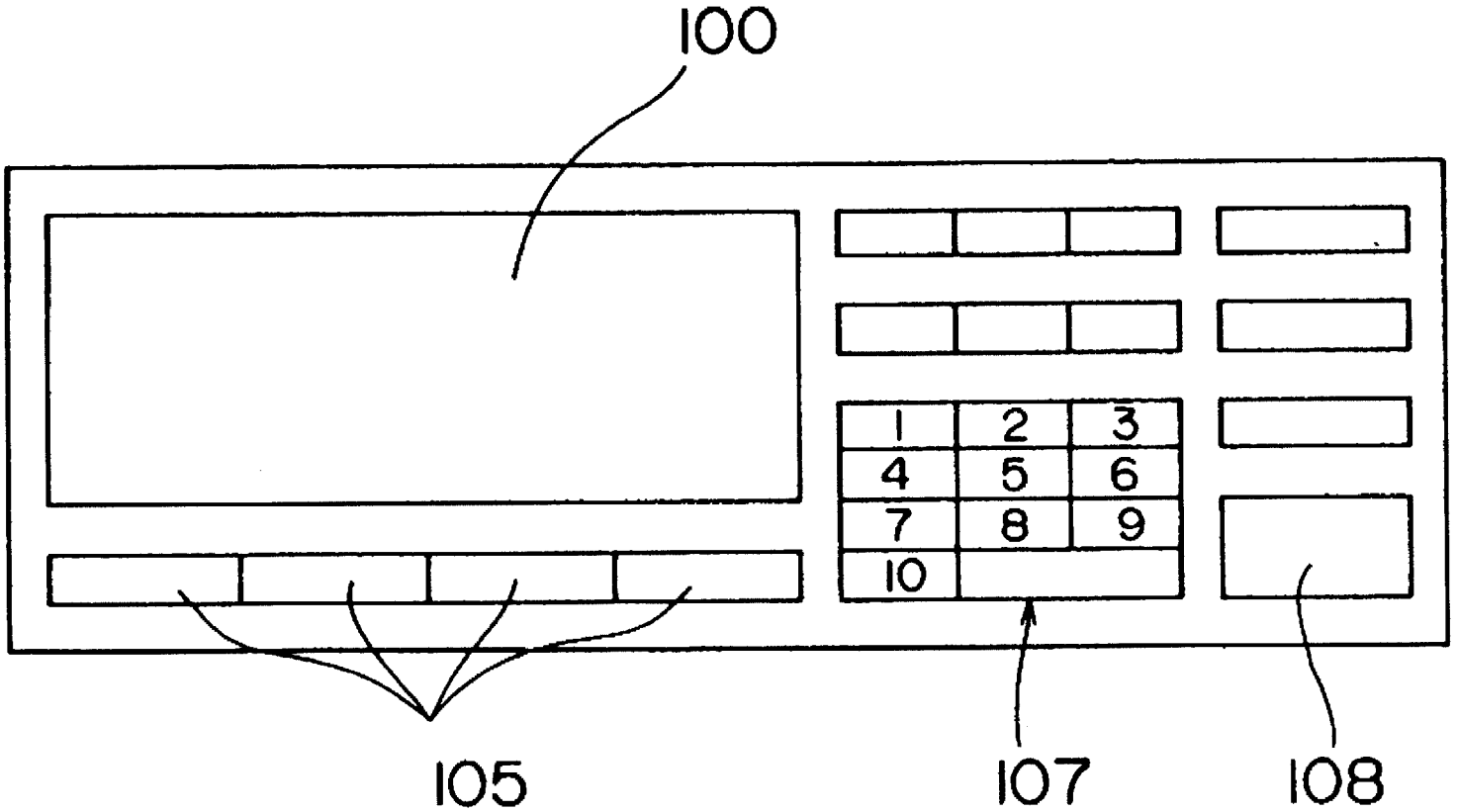
FIG. 2 is a front view illustrating the external arrangement of an operating section provided in a copying machine.

FIG. 2 is a front view illustrating the external arrangement of an operating section (not shown in FIG. 1) disposed at an upper front portion of the copying machine.

The operating section has a display 100 approximately at the center thereof which comprises, for example, a liquid crystal display (LCD). Disposed under the display 100 in FIG. 2 are a plurality of mode (actuation) keys 105 for selecting any one of plural options presented in the display 100. The options in the display 100 are presented at positions corresponding to their respective mode setting keys 105. An option is selected by pressing a mode setting key 105 at a position corresponding to the option to be selected.

At the right side of the display 100 in FIG. 2, are ten keys 107 and a print key 108 for giving a directive to start copying.

Figure 3:
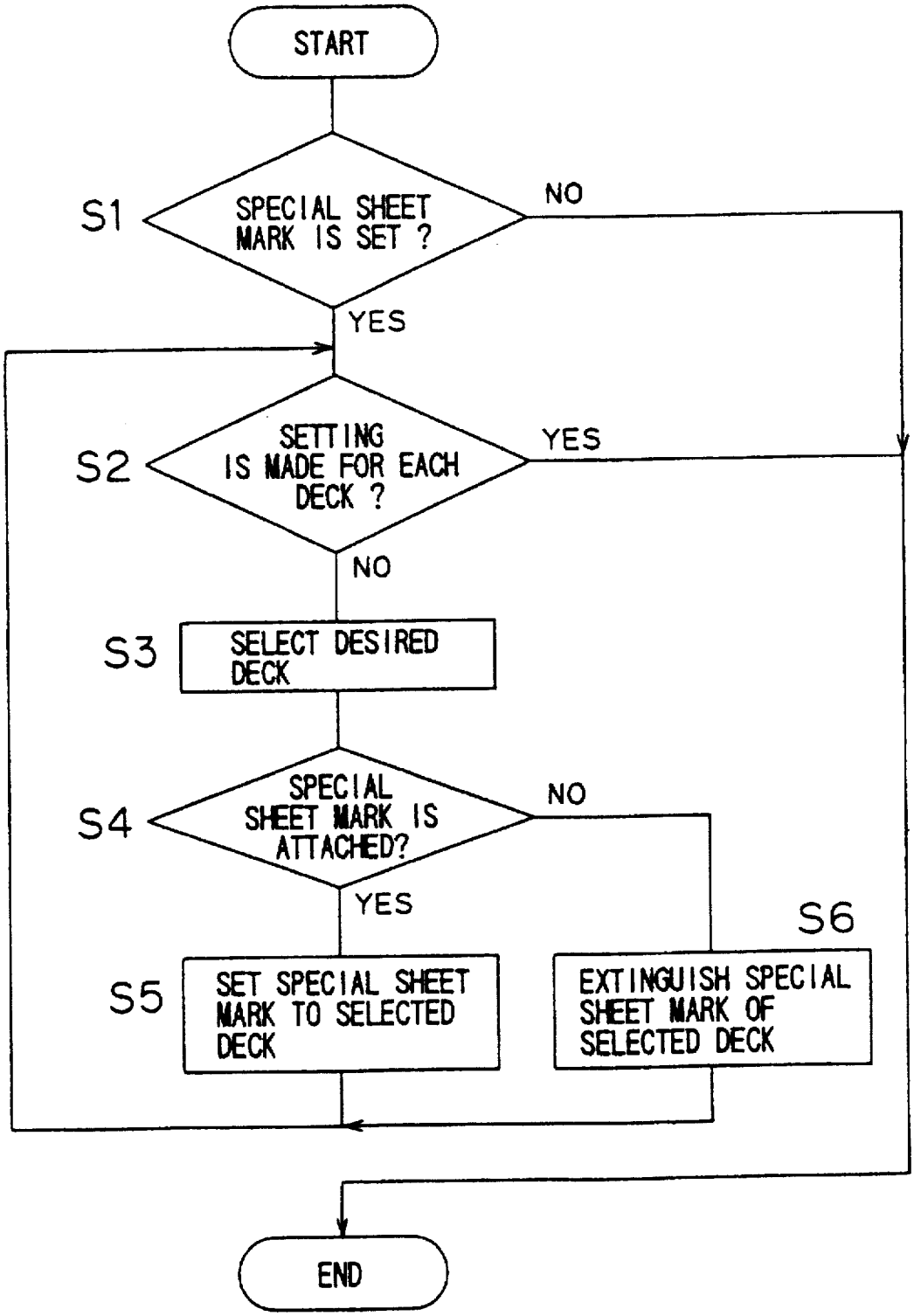
FIG. 3 is a flow chart illustrating the operations for making a setting of a special sheet mark.

FIG. 3 is a flow chart illustrating the operations performed to designate a special sheet mark at a position corresponding to a selected one of the upper deck 53A, the middle deck 53B, the lower deck 53C and the bulk deck 54, which are in a schematic diagram presented in the display 100. FIG. 4 is a diagram illustrating the changes in the presentation in the display 100 as associated with the operations.

The operations of the flow chart are executed by means of software in an unillustrated microcomputer installed in a predetermined position within the main body 1 of the copying machine.

Figure 4A:
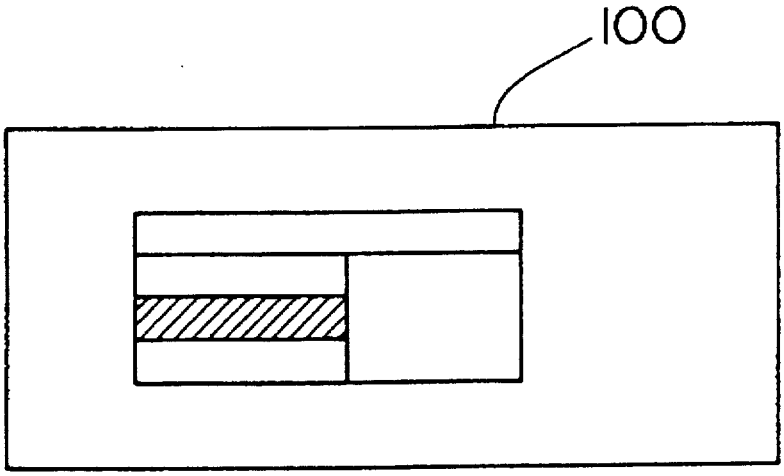
FIGS. 4A and 4B are diagrams schematically illustrating the setting of a special sheet mark for a sheet feeding deck, with FIG. 4A schematically showing the respective positions of sheet feeding decks, and FIG. 4B showing a sheet feeding deck with the special sheet mark attached thereto.

When an operator manually selects the mode to set the special sheet mark (Step S1 of FIG. 3), the display 100 is switched to a presentation of a schematic diagram for illustrating the positions of the respective sheet feeding decks as shown in FIG. 4A.

Figure 4B:
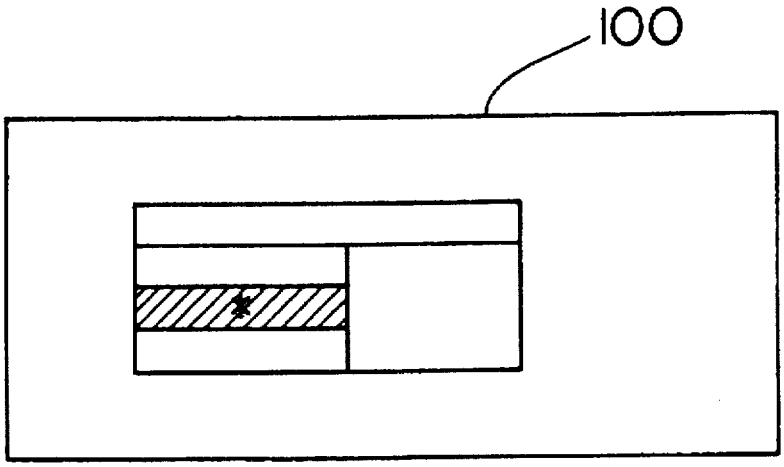

At this time, if the operator selects a desired sheet feeding deck (represented with "hatching line" in the figure) by means of a mode setting key 105 (Step S3), and manipulates the mode setting key 105 to give a directive of attaching the special sheet mark (Step S4), the special sheet mark is set to the corresponding sheet feeding deck (Step S5). FIG. 4B shows the display indicating that the special sheet mark is set.

In this manner, the operator can attach the special sheet mark to a sheet feeding deck holding special sheets. By way of explanation, the special sheet mark is not actually attached to a sheet feeding deck holding the special sheets but a datum indicative of the attachment of the special sheet mark is stored in the memory of CPU.

Next, function setting is made for the respective sheet feeding decks.

The function setting includes making settings such as whether or not the individual sheet feeding decks are designated as the target of automatic sheet selection, whether or not an autochanging function is effected, whether or not a presentation is given upon selection of the sheet feeding deck, and whether or not a locking function is effected on the sheet feeding deck, and the like.

Figure 5:
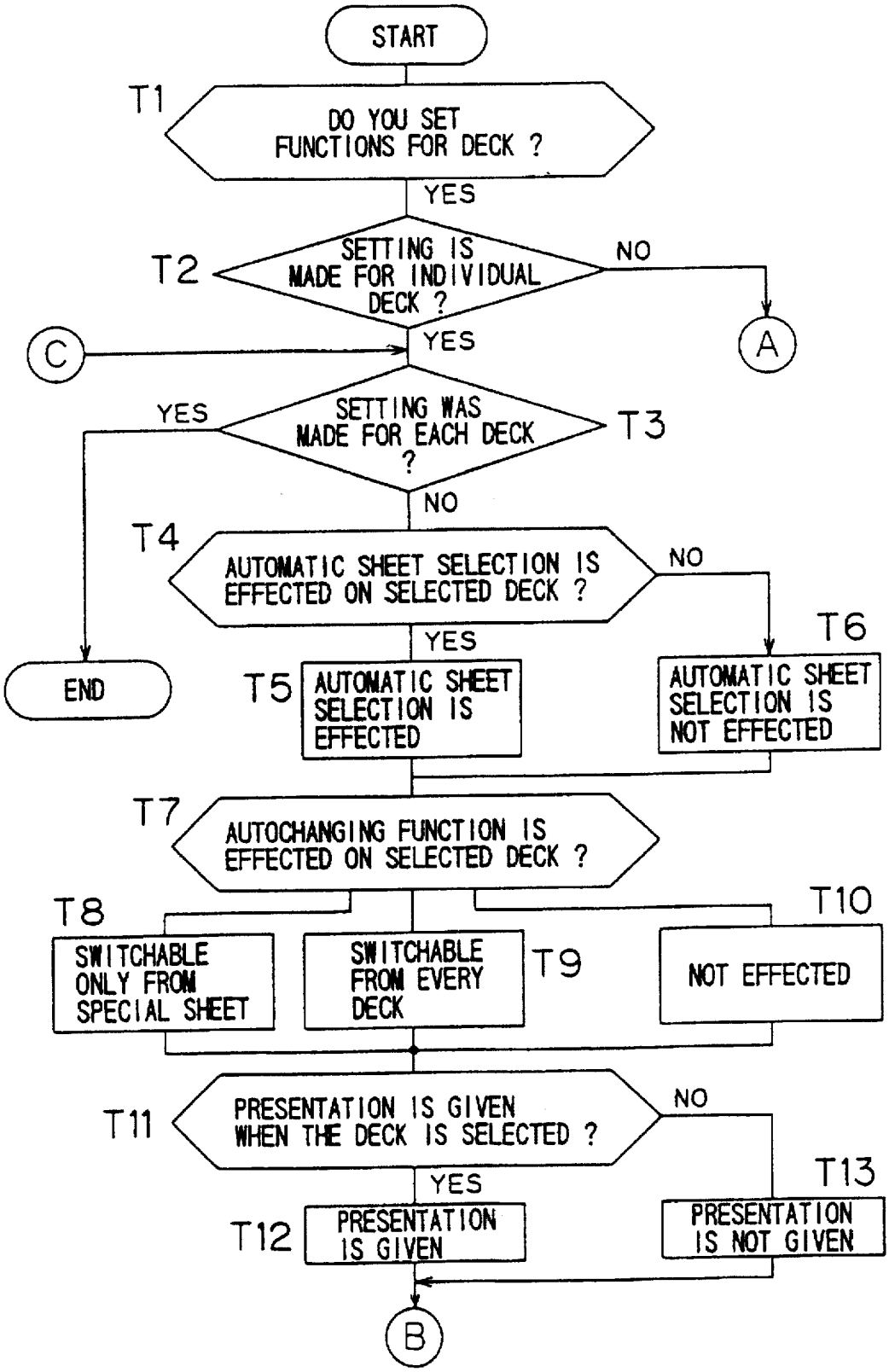
FIGS. 5–8 are a series of interconnected flow charts illustrating the operations for setting functions for the individual sheet feeding decks.
Figure 6:
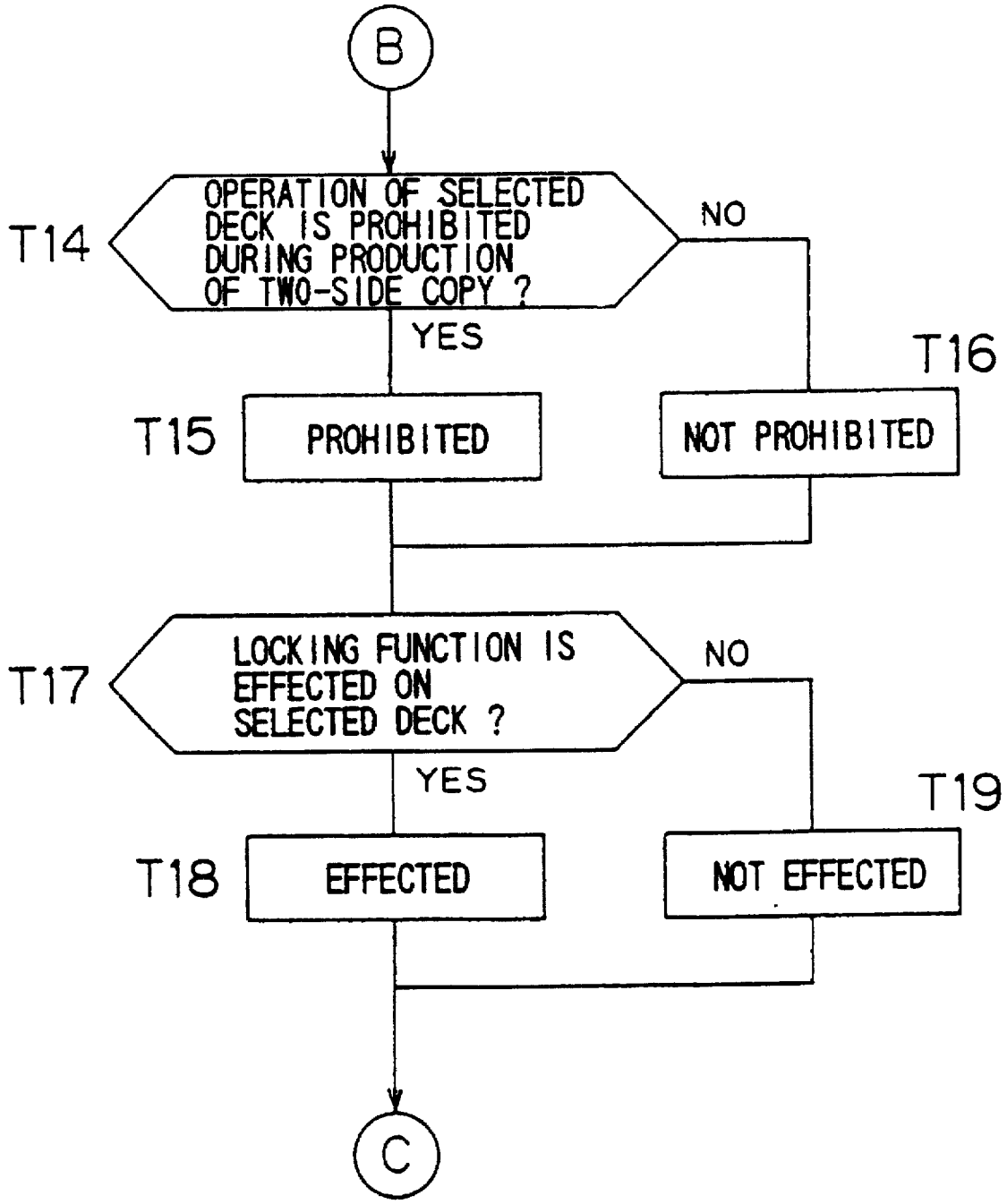
Figure 7:
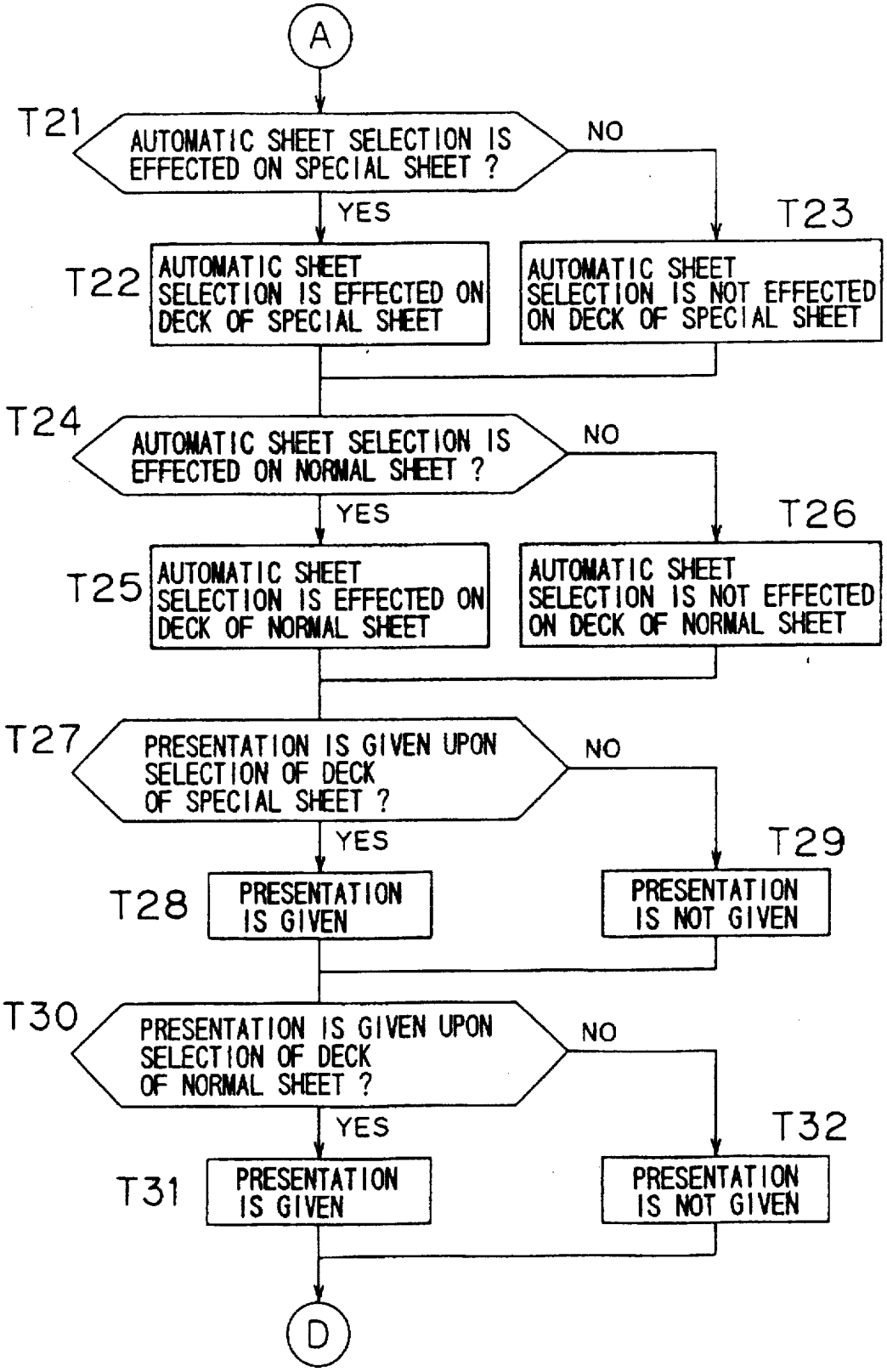

FIGS. 5 through 7 are flow charts illustrating the operations for the function setting.

Now with reference to FIG. 5, the display 100 presents an option of "Automatic mode setting for special sheet" along with a message saying, "Select a mode to be set." When the operator selects this option (Step T1 of FIG. 5), the display presents a message asking if the setting will be made for the individual sheet feeding decks or for all the sheet feeding decks holding special sheets (Step T2).

Firstly, a case wherein the setting is made for the individual sheet feeding decks will be described. This setting is made for both sheet feeding decks holding normal sheets and those holding special sheets regardless of the type of sheets contained therein.

When a directive of making the setting for the individual sheet feeding decks is entered, the display presents a message asking if the automatic sheet selection should be effected (Steps T4 through T6). The automatic sheet selection automatically selects a sheet feeding deck holding sheets of the same size as the detected document original to produce copies. If the automatic sheet selection is not effected (Step T6), sheets in the sheet feeding deck are not subjected to automatic copying even if they are of the same size as the document original.

When the operator selects either of the options, the display presents a message asking if the autochanging function should be effected (Steps T7 through T10). The autochanging function automatically switches from a sheet feeding deck having run out of sheets to feed during the production of copies to another sheet feeding deck holding sheets of the same size. This function is selectable because in some cases, it is not desired to switch to another sheet feeding deck holding special sheets even if the special sheets are of the same size with sheets being used. An option of "Switchable only from special sheets" in Step T8 allows automatic switching from a sheet feeding deck for special sheets to another deck only when the sheet feeding deck of special sheets has run out of sheets to feed. An option of "Switchable from every sheet feeding deck" in Step T9 allows automatic switching from a sheet feeding deck having run out of sheets to feed to another sheet feeding deck regardless of the type of sheets contained therein, normal or special sheets.

Next, the display presents a message asking if a presentation should be set upon selection of a sheet feeding deck (Steps T11 through T13). The presentation of selection of a sheet feeding deck means that a presentation is given in some form when the sheet feeding deck is selected during the production of copies, thereby bringing the selection to the attention of the operator.

Thereafter, the display presents a message asking if the operation of the sheet feeding deck should be prohibited during the production of two-sided copies (Steps T14 through T16). This question is given because if sheets to be used again as special sheets are copied on both sides thereof, the back side thereof will be overprinted with another text and thus become unreadable.

Finally, the display presents a message asking if the locking function should be effected on the sheet feeding deck (Steps T17 through T19). The locking function prohibits the operation of the sheet feeding deck in principle, permitting the operation thereof only when a special password is entered.

When the aforementioned settings have been made for all the sheet feeding decks (Step T3), a series of operations for the automatic mode setting for special sheets are performed, which setting is made for the individual sheet feeding decks.

There is a case wherein instead of making settings for the individual sheet feeding decks, it is desired to make the settings at one time for all the sheet feeding decks holding special sheets, i.d., sheet feeding decks with the special sheet mark attached thereto, or for all the sheet feeding decks with no special sheet mark attached thereto.

In this case, the aforementioned function settings may or may not be made at the same time for all the sheet feeding decks holding special sheets, or for all sheet feeding decks holding normal sheets.

Figure 8:
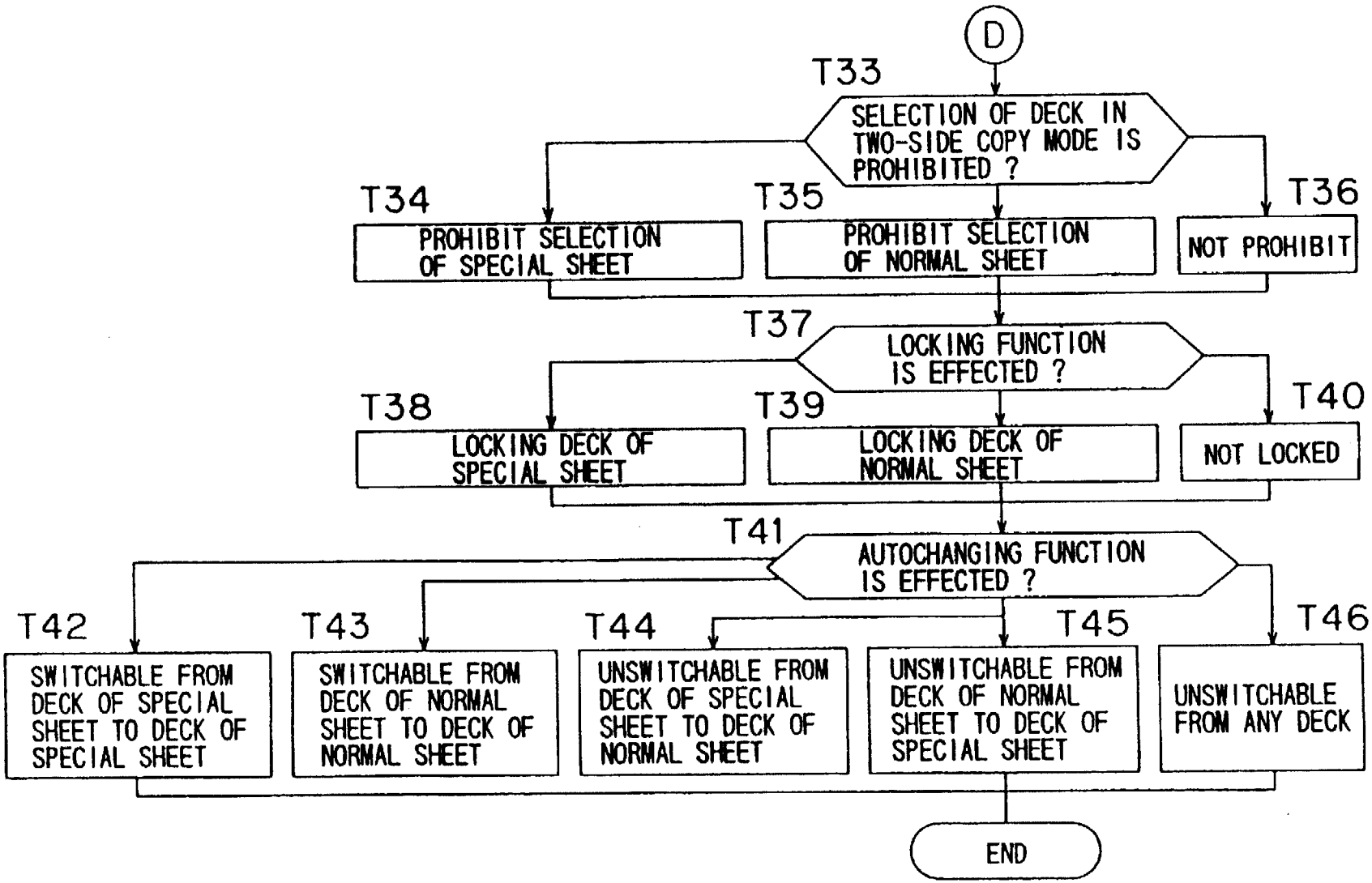

FIGS. 7 and 8 are flow charts for illustrating operations for making the settings for plural sheet feeding decks at the same time.

In Steps T21 through T23, whether or not the automatic sheet selection is effected on sheet feeding decks holding special sheets is determined, whereas in Steps 24 through T26, whether or not the automatic sheet selection is effected on sheet feeding decks holding normal sheets is determined.

In Steps T27 through T29, whether or not a presentation is given upon selection of a sheet feeding deck holding special sheets is determined, whereas in Steps T30 through 32, whether or not a presentation is given upon selection of a sheet feeding deck holding normal sheets is determined.

In Steps T33 through T36, whether the selection of a sheet feeding deck in the two-side copy mode is prohibited or not is determined. The modes of the prohibition include "Prohibiting selection of special sheets", "Prohibiting selection of normal sheets" and "Not prohibited".

In Steps T37 through T40, whether or not the locking function is effected on the sheet feeding deck is determined. The modes of the locking function include "Locking a sheet feeding deck of special sheets", "Locking a sheet feeding deck of normal sheets", and "Not locked".

In Steps T41 through T46, whether or not the autochanging function is effected on the sheet feeding deck is determined. There are five modes of the autochanging function which include: (a) "Switchable from a sheet feeding deck of special sheets to a deck of special sheets", (b) "Switchable from a sheet feeding deck of normal sheets to a deck of normal sheets", (c) "Unswitchable from a sheet feeding deck of special sheets to a deck of normal sheets", (d) "Unswitchable from a sheet feeding deck of normal sheets to a deck of special sheets" and (e) "Unswitchable from any sheet feeding decks". All the modes provide prohibition of autochanging between normal sheets and special sheets, which prevents the resultant copies from including normal sheets and special sheets as mixed together.

As described above, the operator is allowed to make the setting for all sheet feeding decks at the same time and thus is saved time and trouble for the setting procedure.

By way of some examples, what operations are performed and what presentations are given with the aforementioned settings thus made will be described.

Figure 9:
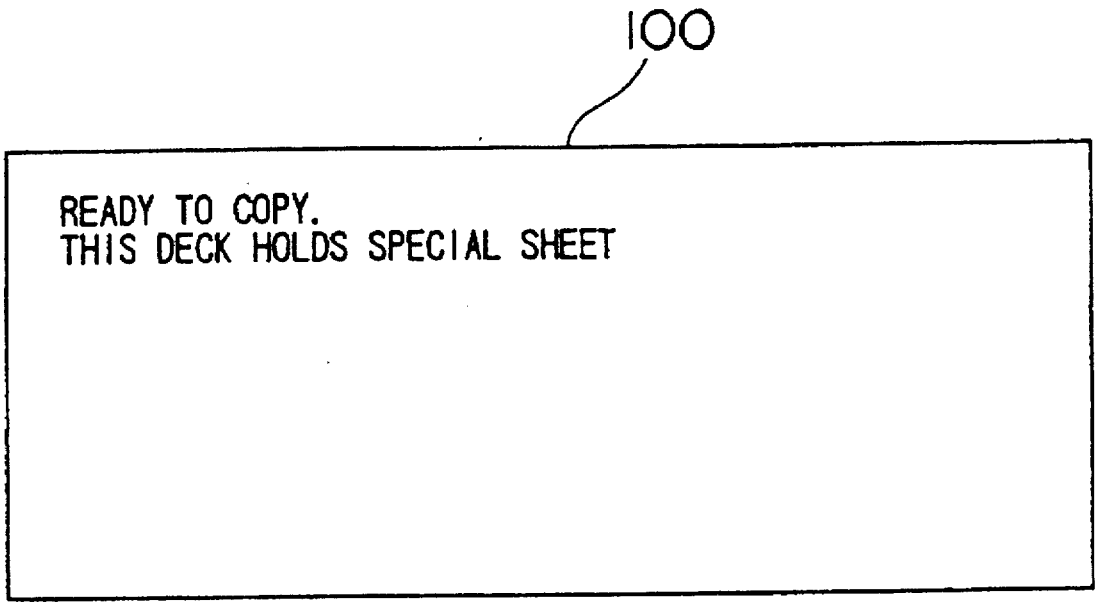
FIG. 9 is a diagram illustrating a presentation which is given upon selection of a special sheet feeding deck loaded with special sheets.

FIG. 9 shows an example of a warning message to the operator. Specifically, if it is determined to give a presentation of the sheet feeding deck holding special sheets upon selection of a sheet feeding deck in Step T11 in the flow chart of FIG. 5, the display 100 presents a message upon selection thereof which says, "Ready to copy. This sheet feeding deck holds special sheets." as shown in FIG. 9.

From this presentation, the operator understands that special sheets will be selected as copy sheets and therefore, can avoid such a mistake as the production of two-sided copies on reused sheets.

Figure 10:
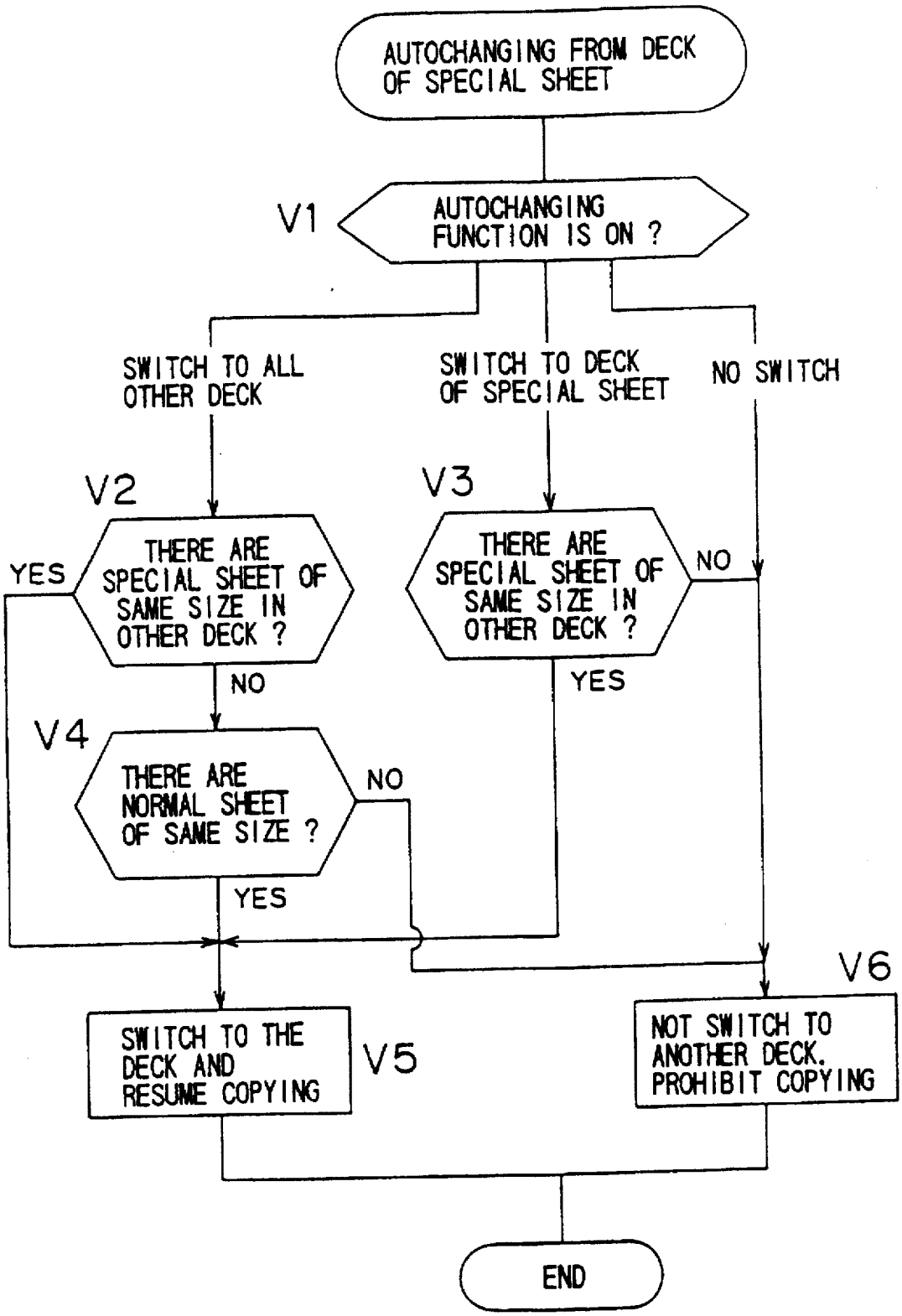
FIG. 10 is a flow chart illustrating the operations performed when special sheets are used up during the actual production of copies in an autochanging mode.

FIG. 10 is a flow chart illustrating the operations performed in the autochanging mode as set in Steps T7 through T10 in the flow chart of FIG. 5, when special sheets are used up during the actual production of copies. According to this flow, whether the setting of the autochanging function is made or not and the content of the setting is judged in Step V1. The allowability to switch from the sheet feeding deck to all the other sheet feeding decks, whether or not another sheet feeding deck of special sheets accommodates sheets of the same size, is checked in Step V2. If there are no special sheets of the same size contained therein, whether or not a sheet feeding deck of normal sheets accommodates sheets of the same size is judged in Step V4. If desired sheets are found in either of the sheet feeding decks, the sheet feeding of the special sheets is switched to the sheet feeding deck thus found to resume the production of copies (Step V5).

If it is allowed to switch from the sheet feeding deck to a sheet feeding deck of special sheets in Step V1, whether or not another sheet feeding deck of special sheets holds sheets of the same size is checked in Step V3. If sheets of the same size are not found, the production of copies is prohibited instead of switching to another sheet feeding deck, and a message is presented which says, "Run out of sheets. Replenish the sheet feeding deck." If there are sheets of the same size, the sheet feeding is switched to such sheet feeding deck to resume the production of copies (Step V5).

In this manner, the autochanging from an initially selected sheet feeding deck is restricted to a selectable sheet feeding deck, whereby a problem that unwanted sheets are mixed in is prevented.

Figure 11:
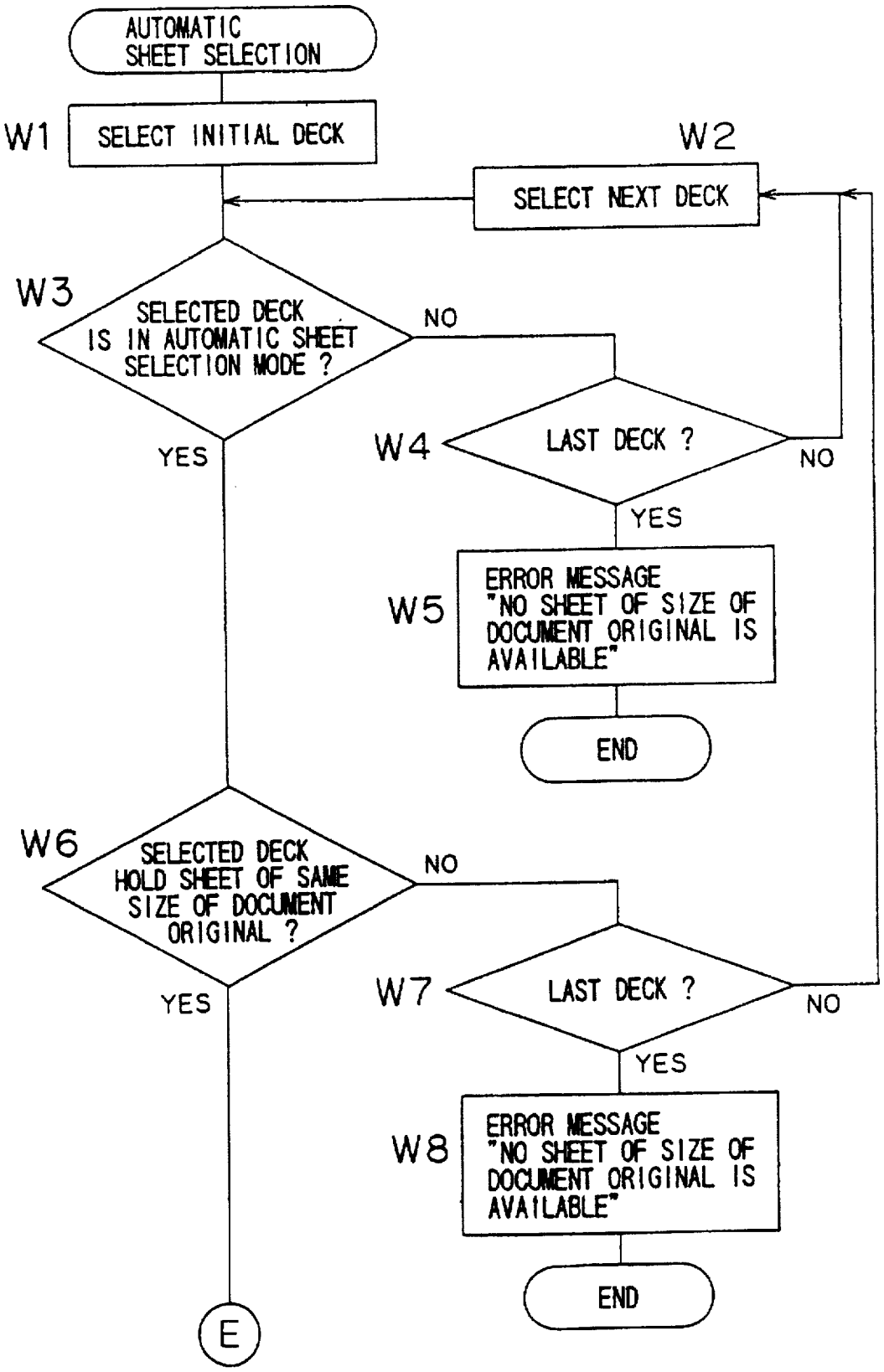
FIGS. 11 and 12 are flow charts illustrating the operations performed to select a sheet feeding deck during the actual production of copies in an automatic sheet selection mode.
Figure 12:
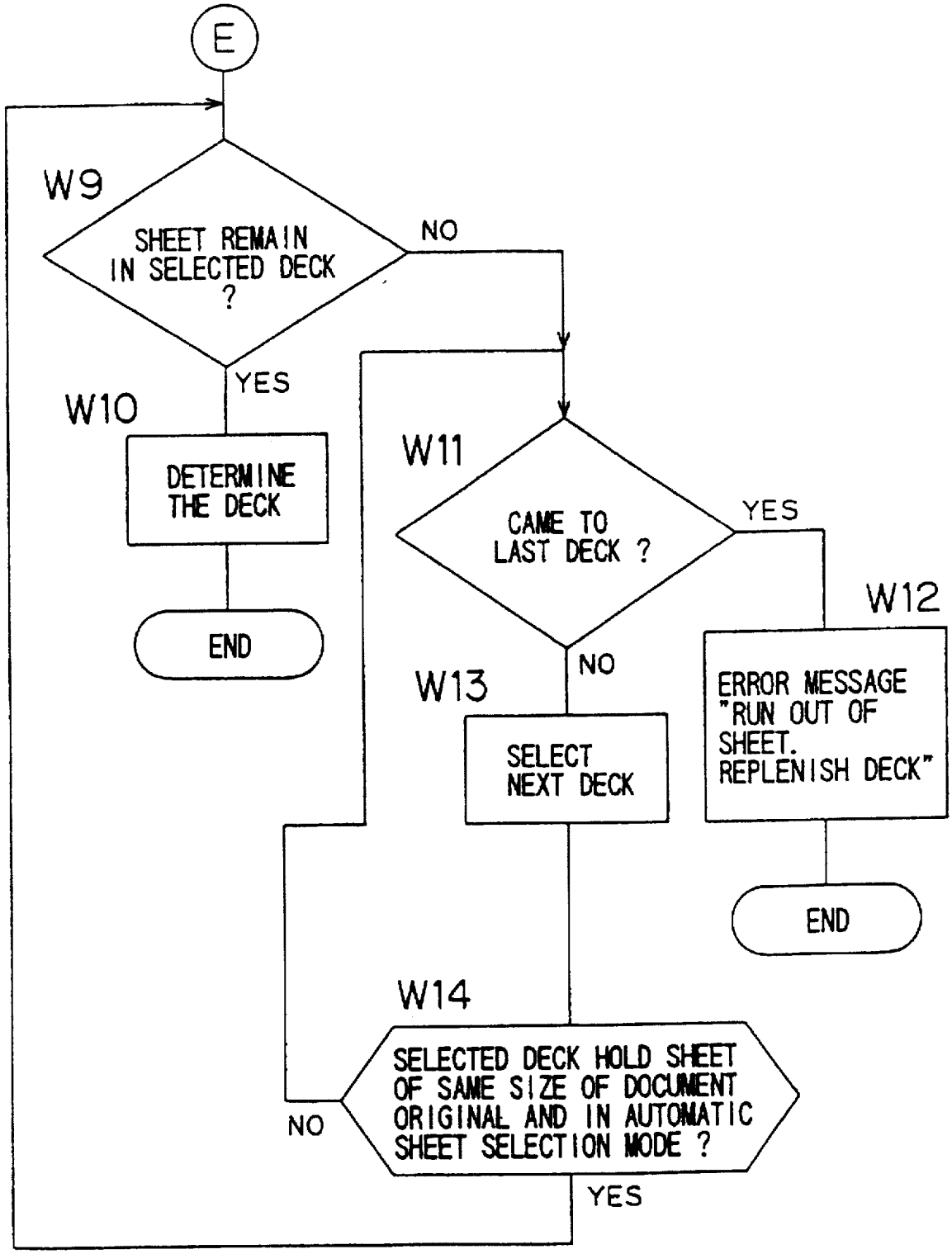

FIGS. 11 and 12 are flow charts illustrating the operations performed to select a sheet feeding deck in the actual production of copies when the automatic sheet selection is set in Steps T4 through T6 in the flow chart of FIG. 5.

According to this flow, an initial sheet feeding deck is selected from the upper deck 53A, the middle deck 53B, the lower deck 53C and the bulk deck 54 (optional) in Step W1, and whether or not the selected sheet feeding deck is in the automatic sheet selection mode is judged (Step W3). If it is not in this mode, the sheet feeding deck is switched to the next one sequentially, judging each time whether the sheet feeding deck is in the automatic sheet selection mode or not. If there is no sheet feeding deck set in the automatic sheet selection mode, an error message is presented which says, "No sheet of the size of the document original is available"

(Step W5). This message may be replaced by one saying, "No sheet feeding deck selectable."

If there is found a sheet feeding deck set in the automatic sheet selection mode, judgment is made whether or not a sheet feeding deck holds sheets of the same size with a document original (Step W6). If it does not contain sheets of the same size, it is switched to the next sheet feeding deck sequentially (Step W7), judging each time in a similar manner. If there is no sheet feeding deck holding sheets of the same size, an error message is presented which says, "No sheet of the size of the document original is available" (Step W8).

If there is found a sheet feeding deck holding sheets of the same size as the document original, judgment is made whether or not some sheets remain in the sheet feeding deck thus found (Step W9). If some sheets remain therein, the sheet feeding deck is selected to start the copying procedure (Step W10).

If there remains no sheets, judgment is made whether or not there is another sheet feeding deck set in the automatic sheet selection mode, holding sheets of the same size with the document original (Step W14). If there are no such sheets, an error message is presented which says, "Run out of sheets. Replenish the sheet feeding deck." (Step W12).

Thus, the selection is restricted to sheet feeding decks which are initially set in the automatic sheet selection mode, whereby preventing the automatic selection of a sheet feeding deck holding special sheets which should not be automatically selected.

As described above, this embodiment is capable of identifying a sheet feeding deck holding special sheets so that some operations may be permitted or prohibited with respect to the identified sheet feeding deck or the other sheet feeding decks.

This enables the handling of special sheets as desired.

Figure 13A:
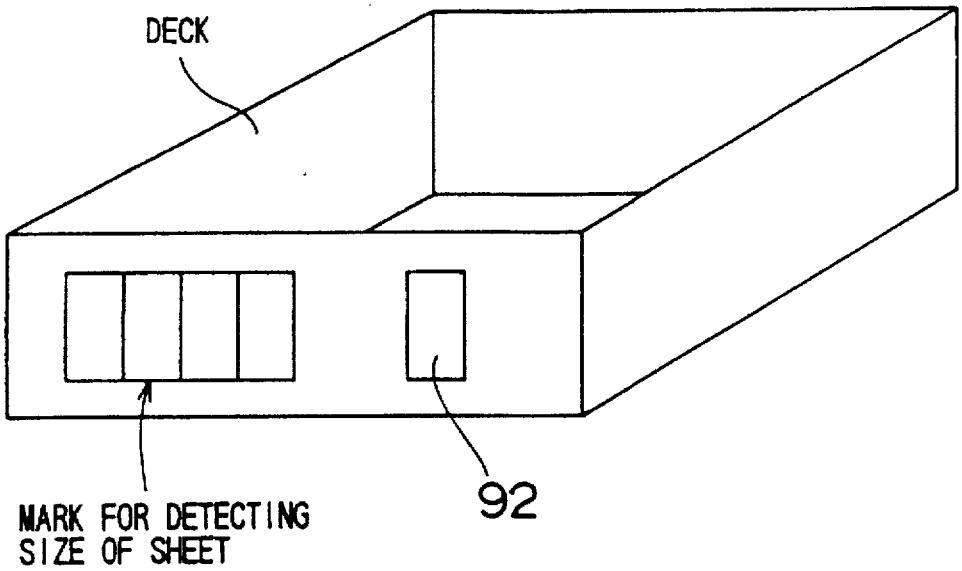
FIGS. 13A and 13B are diagrams illustrating an arrangement wherein an identification sensor is used to read a special sheet mark when the sheet feeding deck contains special sheets, with the special sheet mark being affixed to a rear end surface of the deck for specifying the same, is received by the main body 1 of a copying machine, whereby the special sheet feeding deck is specified.

The present invention should not be limited to the aforementioned embodiments. For example, the foregoing example, as illustrated with reference to FIGS. 3, 4A and 4B, is arranged such that the operator identifies a sheet feeding deck containing special sheets through key entry. However, alternatively a special sheet mark 92, e.g., an optically identifiable reflector plate or a magnetically identifiable magnetic material, may be affixed to the rear end surface of a sheet feeding deck, as shown in FIG. 13A, such that a sheet feeding deck holding special sheets may be specified by an identification sensor 91 for reading the special sheet mark 92 as it is received by the main body 1 of the copying machine (see FIG. 13B).

Figure 13B:
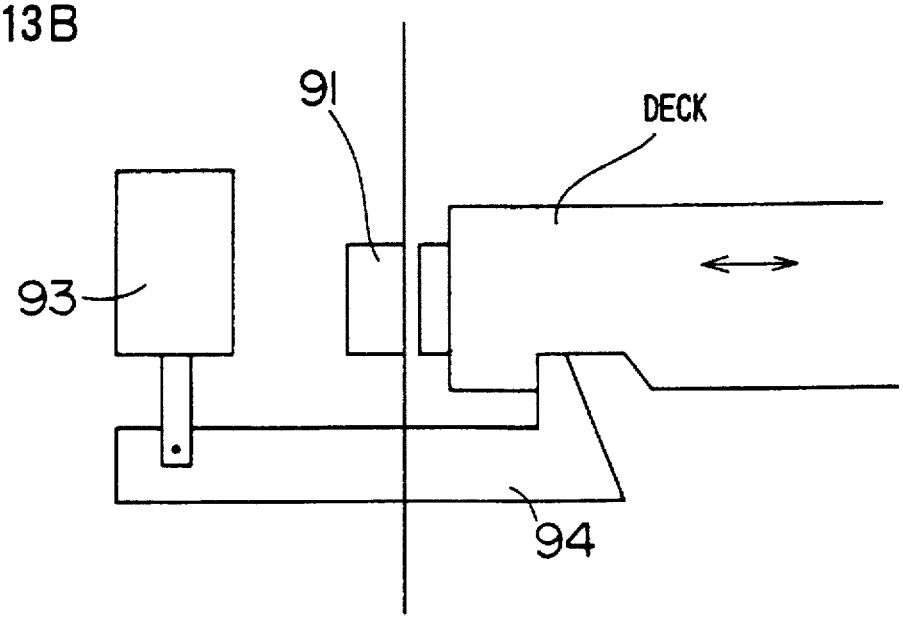

When the sheet feeding deck is selected for feeding sheets, the operation thereof is locked unless a predetermined password is entered to release the locking. Such locking means may be comprised of the combination of a solenoid 93 and a lock arm 94, as shown in FIG. 13B.

While the foregoing embodiment is described by way of an example of a copying machine incorporating the present invention, the present invention is applicable to a facsimile apparatus and other image forming apparatuses.

What is claimed is:

1. An image forming apparatus having a plurality of sheet feeding decks each accommodating a plurality of copy sheets, with each feeding deck holding either normal copy sheets or special copy sheets, wherein one of the group of either the normal copy sheets or special copy sheets are blank on both sides, and the other of the group of the normal copy sheets and the special copy sheets has markings on at least one side, said apparatus being adapted to form an image of an original document on a selected copy sheet previously accommodated in any one of the sheet feeding decks, comprising:

an operating section accessible by an operator, and including:

mode selecting means activatable by the operator for selecting a specific sheet mode;

displaying means having a display for displaying a schematic diagram illustrating the positions of the respective sheet feeding decks when the specific sheet mode is selected;

selecting means activatable by the operator for selecting a specific sheet feeding deck from the sheet feeding decks displayed by said displaying means;

designating means activatable by the operator for designating the specific sheet feeding deck as accommodating the special sheets; and identifying means for identifying in the display the designated specific sheet feeding deck, so as to distinguish the designated specific sheet feeding deck from the other sheet feeding decks; and control means operatively connected to said operating section for permitting and prohibiting selected reproduction procedures on at least one of the special copy sheets accommodated in the designated specific sheet feeding deck and the copy sheets accommodated in the other sheet feeding decks.

2. The image forming apparatus defined in claim 1, wherein said operating section further comprises actuation keys operatively connected to said mode selecting means, said selecting means, and said designating means, said actuation keys being activatable by the operator to respectively activate said mode selecting means, said selecting means, and said designating means.

3. An image forming apparatus having a plurality of sheet feeding decks each accommodating a plurality of copy sheets, with each feeding deck holding either normal copy sheets or special copy sheets, wherein one of the group of either the normal copy sheets or special copy sheets are blank on both sides, and the other of the group of the normal copy sheets and the special copy sheets has markings on at least one side, said apparatus being adapted to form an image of an original document on a selected copy sheet previously accommodated in any one of the sheet feeding decks, comprising:

specific sheet feeding deck designating means for designating at least one sheet feeding deck as accommodating the special copy sheets; and controlling means operatively connected to said designating means for prohibiting an operation that designates the special copy sheets as the target of an automatic sheet selection procedure, so as to prevent the intermixing of the special copy sheets with the normal copy sheets.

4. The image forming apparatus defined in claim 3, wherein said designating means designates the sheet feeding deck prior to the initiation of an image forming procedure.

5. An image forming apparatus having a plurality of sheet feeding decks each accommodating a plurality of copy sheets, with each feeding deck holding either normal copy sheets or special copy sheets, wherein one of the group of either the normal copy sheets or special copy sheets are blank on both sides, and the other of the group of the normal copy sheets and the special copy sheets has markings on at least one side, said apparatus being adapted to form an image of an original document on a selected copy sheet previously accommodated in any one of the sheet feeding decks, comprising:

specific sheet feeding deck detecting means for detecting at least one sheet feeding deck accommodating the special copy sheets; and controlling means for prohibiting an operation that designates the special copy sheets as the target of an automatic sheet selection procedure, so as to prevent the intermixing of the special copy sheets with the normal copy sheets.

6. The image forming apparatus defined in claim 5, wherein said detecting means detects the sheet feeding deck prior to the initiation of an image forming procedure.

* * * * *